US008485841B2

(12) United States Patent
Schrader

(10) Patent No.: US 8,485,841 B2
(45) Date of Patent: Jul. 16, 2013

(54) CLAMPING SPRING FOR A SPRING-CAGE TERMINAL BLOCK

(75) Inventor: Andreas Schrader, Delbrueck (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/142,882

(22) PCT Filed: Jan. 7, 2010

(86) PCT No.: PCT/EP2010/000039

§ 371 (c)(1),
(2), (4) Date: Sep. 8, 2011

(87) PCT Pub. No.: WO2010/079130

PCT Pub. Date: Jul. 15, 2010

(65) Prior Publication Data

US 2011/0312228 A1 Dec. 22, 2011

(30) Foreign Application Priority Data

Jan. 9, 2009 (DE) ..... 10 2009 004 513

(51) Int. Cl.
*H01R 4/4818* (2006.01)

(52) U.S. Cl.
USPC ..... 439/441

(58) Field of Classification Search
USPC ..... 439/441, 440, 395, 717, 700, 733.1
See application file for complete search history.

(56) References Cited

U.S. PATENT DOCUMENTS

| | | | | |
|---|---|---|---|---|
| 5,454,730 | A | 10/1995 | Tozuka | |
| 6,336,824 | B1 | 1/2002 | Sorig | |
| 6,851,967 | B2 * | 2/2005 | Miyoshi et al. | 439/441 |
| 7,287,999 | B2 * | 10/2007 | Holterhoff et al. | 439/441 |
| 7,329,143 | B2 | 2/2008 | Schrader | |
| 2006/0063419 | A1 * | 3/2006 | Steinkemper et al. | 439/441 |
| 2007/0178747 | A1 * | 8/2007 | Schrader | 439/441 |
| 2010/0173531 | A1 | 7/2010 | Holste | |

FOREIGN PATENT DOCUMENTS

| | | | |
|---|---|---|---|
| DE | 299 20 231 | U1 | 4/2001 |
| DE | 203 12 861 | U1 | 10/2003 |
| DE | 102004059017 | A1 | 6/2006 |
| DE | 102005014075 | B3 | 10/2006 |
| DE | 102005048972 | A1 | 4/2007 |
| DE | 102006005260 | A1 | 8/2007 |
| DE | 601 28 235 | T2 | 12/2007 |
| DE | 102006014646 | B4 | 6/2008 |
| EP | 1 309 036 | A1 | 5/2003 |

OTHER PUBLICATIONS

European Patent Office, International Search Report in International Patent Application No. PCT/EP2010/000039 (Jun. 2, 2010).

* cited by examiner

*Primary Examiner* — Tulsidas C Patel
*Assistant Examiner* — Phuongchi T Nguyen
(74) *Attorney, Agent, or Firm* — Leydig, Voit & Mayer, Ltd.

(57) ABSTRACT

A clamping spring for a spring-cage terminal includes a spring-steel band having a clamping arm, a supporting arm and a flexural joint joining the clamping arm and the supporting arm. The spring-steel band has a greater width in an area of the flexural joint than in an area of the clamping arm and the supporting arm.

12 Claims, 5 Drawing Sheets

CLAMPING SPRING FOR A SPRING-CAGE TERMINAL BLOCK

CROSS REFERENCE TO RELATED APPLICATIONS

This application is a U.S. National Phase application under 35 U.S.C. §371 of International Application No. PCT/EP2010/000039, filed on Jan. 7, 2010, and claims benefit to German Patent Application No. DE 10 2009 004 513.9, filed on Jan. 9, 2009. The International Application was published in German on Jul. 15, 2010 as WO 2010/079130 A1 under PCT Article 21 (2).

FIELD

The present invention relates to a clamping spring for a spring-cage terminal block, a holder element for receiving the clamping spring, as well as a housing in which the holder element, together with the clamping spring, is placeable.

BACKGROUND

The German Examined Specification DE 10 2005 014 075 B3 describes a spring-cage terminal block that includes a clamping spring having a supporting arm and an opposite clamping arm designed to include at least one end portion at an acute angle to the supporting arm. To force the clamping arm apart from the supporting arm, a displaceable pusher element is provided which has a conductor lead-through. To realize a very small-sized spring-cage terminal block of this type having adequate spring force, the clamping spring has a loop shape that includes a rear segment that joins the supporting arm and the clamping arm. This rear segment is configured at a conductor insertion opening in the housing and has a conductor lead-through opening in alignment therewith. The pusher element is configured within the loop form of the clamping spring, and the conductor feed-through opening thereof is in alignment with the conductor lead-through opening in the rear segment of the clamping spring.

It may, in fact, be possible to realize such a spring-cage terminal block having a low overall height whereby a clamping spring located therein has a very small design. However, the mechanical stress distribution in the clamping spring in response to the application of force is negatively affected by such a spring-cage terminal block. Moreover, the pusher element makes this spring-cage terminal block complicated to operate, and the many individual components result in a relatively complex design.

SUMMARY

In an embodiment, the present invention provides a clamping spring for a spring-cage terminal including a spring-steel band having a clamping arm, a supporting arm and a flexural joint joining the clamping arm and the supporting arm. The spring-steel band has a greater width in an area of the flexural joint than in an area of the clamping arm and the supporting arm.

BRIEF DESCRIPTION OF THE DRAWINGS

Exemplary embodiments of the present invention are described in more detail below with reference to the drawings, in which.

DETAILED DESCRIPTION

Figure 1:
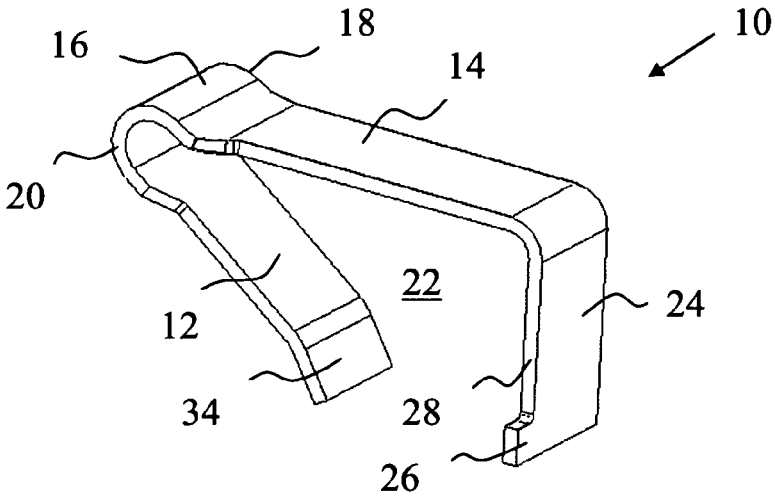
FIG. 1 shows a schematic representation of an embodiment of a clamping spring according to the present invention.

In an embodiment, an aspect of the present invention is to provide a clamping spring for a spring-cage terminal block that will make possible an improved mechanical stress distribution in the clamping spring and to provide a holder element, as well as a housing for a clamping spring of this kind that will feature a simple design using few components.

An embodiment of a clamping spring according to the present invention for a spring-cage terminal block includes a clamping arm and a supporting arm, the clamping arm and the supporting arm being joined to one another via a flexural joint. The clamping arm, the supporting arm and the flexural joint are made from one spring-steel band, the spring-steel band having a greater width in the area of the flexural joint than in the area of the clamping arm and the supporting arm.

The clamping spring has a loop shape whereby the clamping arm is configured at an acute angle to the bearing arm. The flexural joint joining the clamping arm and the bearing arm features a curvature having a smallest possible bend radius, thereby making possible a smallest possible clamping spring design. Since the spring-steel band used for fabricating the clamping spring has a greater width in the area of the flexural joint than in the area of the clamping arm and the supporting arm, a mechanical stress distribution is attainable that allows the clamping space of the clamping spring to be opened to the appropriate width without thereby unacceptably plastically deforming the clamping spring, in spite of the smallest possible bend radius. In this context, the clamping spring is designed so that, at the one edge region thereof, the spring-steel band forms a flush, even surface among the clamping arm, the flexural joint and the supporting arm, and, at the opposite edge region of the spring-steel band, the edge region of the flexural joint projects out from the edge region of the clamping arm and from the edge region of the supporting arm.

In an embodiment the flexural joint to have a bend radius having a value of between 0.3 mm and 0.5 mm, preferably of between 0.4 mm and 0.5 mm. Such a small bend radius permits a smallest possible and space-saving clamping spring design, making it possible to realize spring-cage terminal blocks having a lowest possible overall height.

In an embodiment the clamping spring can have a limiting arm that is integrally formed at one end of the bearing arm opposite the flexural joint. The limiting arm is preferably configured at a 90° angle to the supporting arm at the end thereof opposite the flexural joint. It is likewise formed from the spring-steel band and preferably features the same width as the supporting arm. The limiting arm prevents the conductor to be clamped from being inserted too far into the clamping space of the clamping spring.

To ensure that the limiting arm is not forcible out of its desired position in response to a pressure application, for example by the conductor to be clamped, it features a lug element for fixing it in the desired position. The lug element is preferably configured at an edge region of the limiting arm, it being configured at that end of the limiting arm that does not adjoin the supporting arm. To enable the limiting arm to be fixed in position, the lug element is preferably positionable in an opening of the holder element surrounding the clamping spring.

Another embodiment of the present invention provides that a limiting element also be able to secure the limiting arm to prevent it from being pushed away by force. The limiting element is preferably configured on the lateral surface of the limiting arm facing away from the clamping space and may be designed, for example, in the form of a U-shape angled arm, thereby allowing a uniform counterpressure force to be exerted on the limiting arm. Such a limiting element may be provided in addition to the lug element or, however, also alone without the lug element.

To achieve a desirable clamping angle between the clamping arm of the clamping spring and the conductor to be clamped, another preferred embodiment of the present invention provides that the clamping arm feature a region that is bent relative thereto at the end thereof opposite the flexural joint.

An embodiment of present invention also relates to a holder element for accommodating a clamping spring that is designed and further refined in the above described manner, the holder element being manufactured from an electrically conductive material and being essentially U-shaped. The material of the holder element may be composed of an electrically conductive spring-steel band. The U-shaped design may be constituted of a flat plate featuring two mutually opposing brackets that are preferably configured on the flat plate at a 90° angle thereto. The holder element features a considerable variance since, given an unchanging U-shaped configuration of the holder element, the use of an identically formed spring element and an unchanging conductor introduction and actuation region of the housing, a broad array of solder and connector possibilities is feasible using this system. The clamping spring is fixable in position in the U-form of the holder element between the two brackets, the supporting arm of the clamping spring being positionable to rest against a bracket of the holder element.

In accordance with an embodiment, the holder element has an opening in which a limiting arm of the clamping spring is fixable in position in the holder element via a lug element that is integrally formed on the limiting arm. Given a clamping spring that is inserted in the holder element, the limiting leg is preferably configured in the holder element between the two brackets of the holder element. The opening is preferably provided on the plane surface of the holder element, the opening preferably being the exact size needed to fix the lug element in position therein without requiring any further components.

Another embodiment of the present invention provides for a recess at one of the lateral surfaces of the holder element in order to limit the insertion depth of a tool. The recess is provided in the area of the flat plate of the holder element and may preferably span a portion of the flexural joint and of the clamping arm of the clamping spring configured within the holder element. To open the clamping spring to be able to clamp a conductor, a tool is introduced into the holder element, the tool thereby pressing the clamping arm of the clamping spring toward the clamping space. The recess is used as a limit stop, thereby making it possible to prevent the tool from being introduced too far into the holder element, into the clamping space of the clamping spring, which would otherwise result in overextension of the clamping arm. The recess is preferably configured to allow the clamping spring, via the flexural joint thereof, to come to rest against the recess in response to an ample deflection of the clamping arm upon introduction of a tool, thereby preventing a further introduction of the tool.

Another embodiment of the present invention provides that the holder element also have a protuberance that is used as a stop element for a clamping arm of the spring clamp. The protuberance is preferably configured in the area of the flat plate of the holder element underneath the supporting arm, the protuberance extending into the clamping space of the spring clamp. If the clamping arm is pressed into the clamping space by the introduction of a tool, it is then only deflectable to the point where it comes to rest against the protuberance. The protuberance may prevent the clamping arm from being overextended in response to a too pronounced deflection.

The holder element may be configured in a housing, preferably in an insulating housing. Another embodiment of the present invention provides that the holder element feature a detent lug for fixing the holder element in position in the housing. The detent lug is preferably provided on an outer surface of the holder element that is oriented away from the clamping spring located in the holder element, preferably in the region of a bracket of the holder element. The detent lug makes it readily possible for a holder element to be fastened to and/or released from a housing surrounding the same.

The present invention also relates to a housing for accommodating a holder element which is designed and further refined in the above described manner. The housing features a receiving opening for a tool, as well as a conductor insertion opening. The receiving opening for the tool features a wall element designed as a stop element for a clamping spring that has been placed in the holder element, and for fixing in position the tool that has been received in the receiving opening. The housing is preferably an insulating housing that surrounds the electrically conductive holder element. The housing preferably has a receiving opening for a tool, into which a tool, preferably a screwdriver, is introducible in the direction of the holder element, in order to open the clamping spring located in the holder element by deflecting the clamping arm of the clamping spring in the direction of the clamping space, to enable a conductor, that has been introduced via the conductor insertion opening, to be clamped in the clamping spring, or an already clamped conductor to be released. The receiving opening features a wall element that surrounds the opening and is used for guiding the tool movement. In this context, the wall element preferably at least partially abuts the clamping spring located in the holder element, preferably in the area of the flexural joint and/or of the clamping arm, and serves thereby as a stop element for the clamping spring since the freedom of motion of the clamping spring in this area is limited by the wall element of the housing. In addition, the wall element is formed in a way that allows it, in coordination with the holder element and the clamping spring, to clamp the tool to be inserted for opening the clamping space, so that the operator does not need to hold the tool to introduce or connect the conductor in the clamping spring, but rather has both hands free for that purpose. Thus, the operation of the spring-cage terminal block is greatly facilitated for an operator.

Another embodiment of the present invention provides that the conductor insertion opening be designed as a limitation to a deflection movement of a clamping arm of a clamping spring located in the holder element. The housing preferably features a conductor insertion opening. The conductor insertion opening preferably has a funnel-shaped design. On the one hand, the conductor insertion opening is used as a limit stop for the holder element and, on the other hand, as a limitation to a deflection movement of a clamping arm of a clamping spring located in the holder element, the conductor insertion opening preferably being configured in the area of the bent region of the clamping arm.

Another embodiment of the present invention provides that the housing feature a recess into which a detent lug configured on the holder element is fastenable in order to fix the holder element in position on the housing, through which means the holder element is securely positionable in the housing in the desired position.

FIG. 1 shows a clamping spring 10 according to the present invention in accordance with one preferred exemplary embodiment. Clamping spring 10 has a clamping arm 12, a supporting arm 14 and a flexural joint 16; clamping arm 12 and supporting arm 14 being joined to one another via flexural joint 16. Clamping arm 12, supporting arm 14 and flexural joint 16 are fabricated from a spring-steel band, the spring-steel band having a greater width in the area of flexural joint 16 than in the area of clamping arm 12 and supporting arm 14. At one edge region 18 thereof, the spring-steel band forms a flush, even surface among the clamping arm, the flexural joint and the supporting arm. On the other hand, at opposite edge region 20 of the spring-steel band, edge region 20 in the area of flexural joint 16 projects out from the edge region in the area of clamping arm 12 and from supporting arm 14, as is clearly discernible in FIG. 1.

Flexural joint 16 joining clamping arm 12 and bearing arm 14 features a curvature having a smallest possible bend radius, thereby making possible a smallest possible design of clamping spring 10. Since the spring-steel band, out of which clamping spring 10 is fabricated, has a greater width in the area of flexural joint 16 than in the area of clamping arm 12 and supporting arm 14, a mechanical stress distribution is attainable that permits opening of clamping space 22 of clamping spring 10 to the appropriate width without thereby unacceptably plastically deforming clamping spring 10, in spite of the smallest possible bend radius. Clamping space 22 is formed by clamping arm 12, limiting arm 14, flexural joint 16 and a limiting arm 24 integrally formed at the end of supporting arm 14 opposite flexural joint 16. Limiting arm 24 is preferably configured on supporting arm 14 at a 90° angle thereto and is likewise formed from the spring-steel band and preferably features the same width as supporting arm 14. To ensure that limiting arm 24 is not forcible out of its desired position by the application of a pressure, for example by a conductor to be clamped, it features a lug element 26 for fixing it in the desired position. Lug element 26 is preferably configured at an edge region 28 of limiting arm 24, which, upon insertion of clamping spring 10 into a holder element 30 shown in FIG. 2, rests against holder element 30, lug element 26 preferably being configured at that end of limiting arm 24 that does not adjoin supporting arm 14. To fix limiting arm 24 in position, lug element 26 is preferably positionable in an opening 32 of a holder element 30 surrounding clamping spring 10.

Clamping arm 12 preferably features a region 34 that is bent relative thereto at the end thereof opposite flexural joint 16, making it possible to achieve a most optimal possible clamping angle between clamping arm 12 of clamping spring 10 and the conductor to be clamped.

Figure 2:
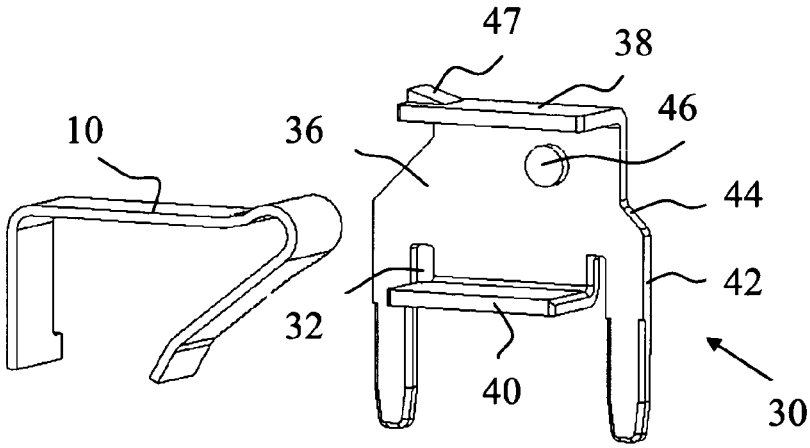
FIG. 2 shows a schematic representation of an embodiment of a holder element according to the present invention and a clamping spring that is insertable into the holder element.

FIG. 2 shows a preferred specific embodiment of a holder element 30 according to the present invention for receiving a clamping spring 10 as shown in FIG. 1. Holder element 30 is manufactured from an electrically conductive material and is essentially U-shaped and has a flat plate 36 featuring two mutually opposing brackets 38, 40 that are preferably configured on flat plate 36 at a 90° angle thereto. Clamping spring 10 is fixable in position in the U-form of holder element 30 between the two brackets 38, 40, supporting arm 14 of clamping spring 10 being positionable to rest against bracket 38 of holder element 30. In the area of the flat plate thereof, holder element 30 features an opening 32 into which lug element 26 of limiting leg 24 of clamping spring 10 is insertable, so that limiting arm 24 is not forcible out of its desired position. A recess 44, which limits the insertion depth of a tool (not shown here) into clamping space 22 of clamping spring 10, is provided on a lateral surface 42 of flat plate 36 of holder element 30. To open clamping spring 10 to allow a conductor (not shown here) to be clamped, a tool is introduced into holder element 30, the tool thereby pressing clamping arm 12 of clamping spring 10 toward clamping space 22. Recess 44 serves as a limit stop, thereby making it possible to prevent the tool from being introduced too far into holder element 30, which would otherwise cause overextension of clamping arm 12. Recess 44 is preferably configured to allow clamping spring 10 to come to rest via its flexural joint 16 against recess 44 in response to an ample deflection of clamping arm 12 upon introduction of a tool, thereby preventing a further introduction of the tool.

Figure 9:
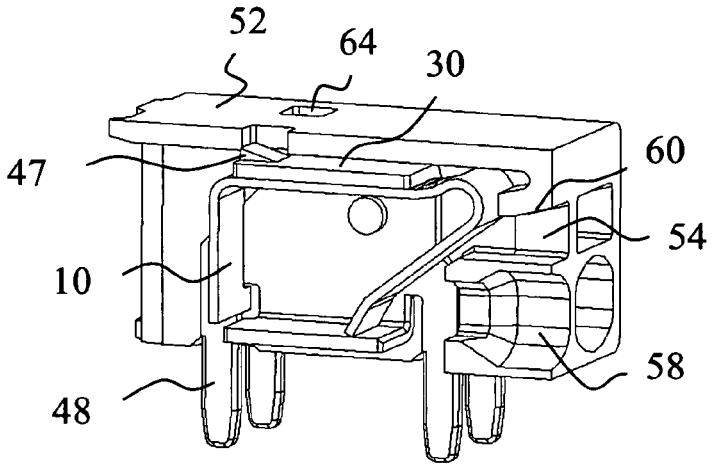
FIG. 9 is a schematic representation of an embodiment of a holder element together with a clamping spring in a housing according to the present invention.

In the area of flat plate 36 thereof, holder element 30 also has a protuberance 46 as a further stop element for clamping arm 12 of clamping spring 10. Protuberance 46 preferably projects into clamping space 22 of clamping spring 10. If clamping arm 12 is pressed into clamping space 22 by the introduction of a tool, it is then only deflectable to the point where it comes to rest against protuberance 46. Protuberance 46 is able to prevent overextension of clamping arm 12 in response to a too pronounced deflection. In addition, a detent lug 47 for fixing holder element 30 in position in a housing (as shown in FIG. 9) is configured at top bracket 38.

Holder element 30, together with clamping spring 10, is shown in an assembled state in FIGS. 3, 4, 5 and 6; the substantial variance of holder element 30 according to the present invention in terms of the hard-soldering thereof being discernible on the basis of FIGS. 3, 4, 5 and 6. Differently designed solder pins 48 configured on holder element 30 permit different forms of hard soldering, such as horizontal, through-hole and SMD, and, for connector systems, standard and inverted; the actual clamping region of holder element 30 in which clamping spring 10 is placeable, preferably always remaining the same.

Figure 3:
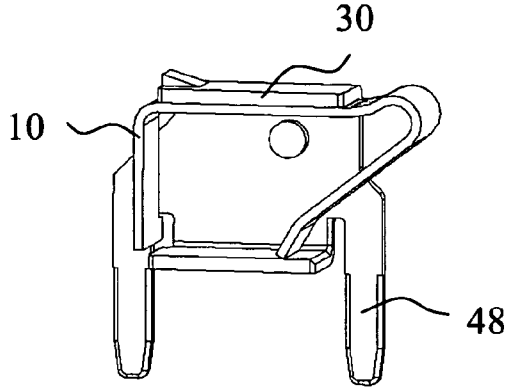
FIG. 3 shows a schematic representation of an embodiment of a clamping spring according to the present invention.
Figure 4:
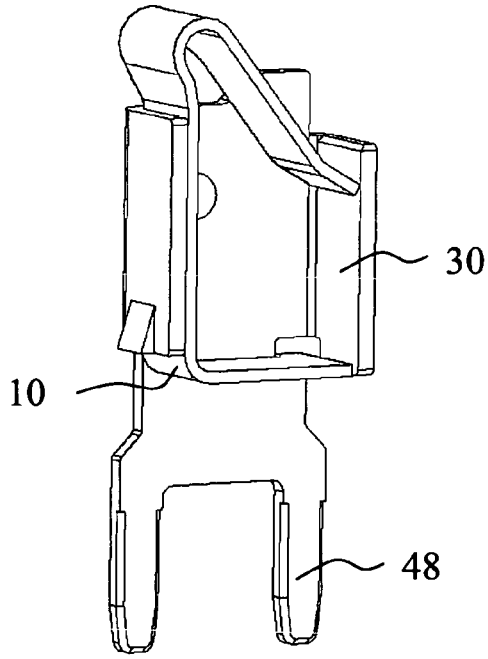
FIG. 4 is a schematic representation of another embodiment of a clamping spring in a holder element according to the present invention.
Figure 5:
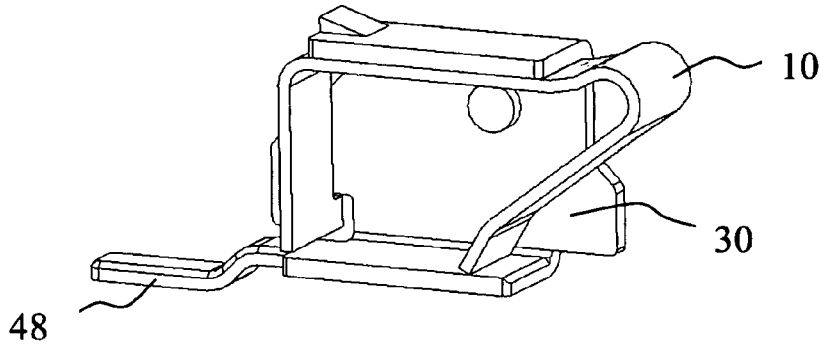
FIG. 5 is a schematic representation of another embodiment of a clamping spring in a holder element according to the present invention.
Figure 6:
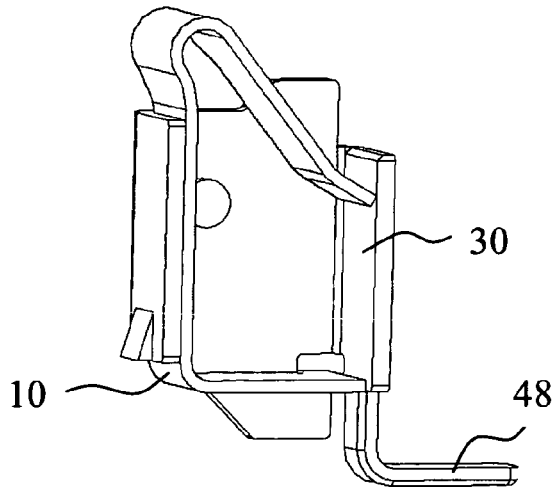
FIG. 6 is a schematic representation of yet another embodiment of a clamping spring in a holder element.

To be able to optimally utilize the available overall height of holder element 30, flexural joint 16 is also preferably upwardly offset by the material thickness of holder element 30, so that the top edge of bracket 38 terminates together with the top edge of flexural joint 16 at a height that is clearly discernible in FIG. 3.

Figure 7:
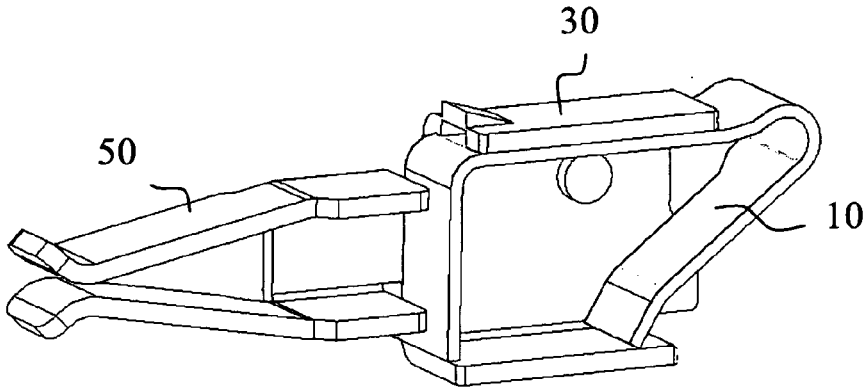
FIG. 7 shows a schematic representation of another embodiment of a clamping spring in a holder element.
Figure 8:
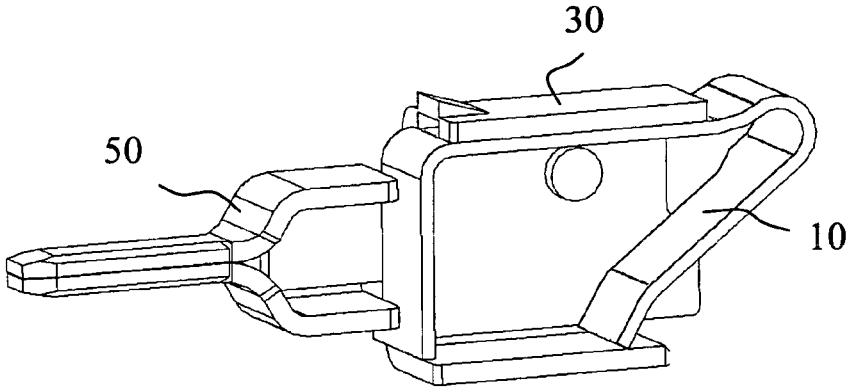
FIG. 8 is a schematic representation of another embodiment of a clamping spring in a holder element.

FIGS. 7 and 8 show another specific embodiment of a holder element 30 and of a clamping spring 10, whereby limiting arm 24 is secured by a limiting element 50 to prevent it from being pushed away. Limiting element 50 is preferably configured on the lateral surface of limiting arm 24 facing away from clamping space 22 and may be designed, for example, in the form of a U-shape angled arm, thereby allowing a uniform counterpressure force to be exerted by the arm on limiting arm 24. Such a limiting element 50 may be provided in addition to lug element 26 or, however, also alone without lug element 26.

Figure 10:
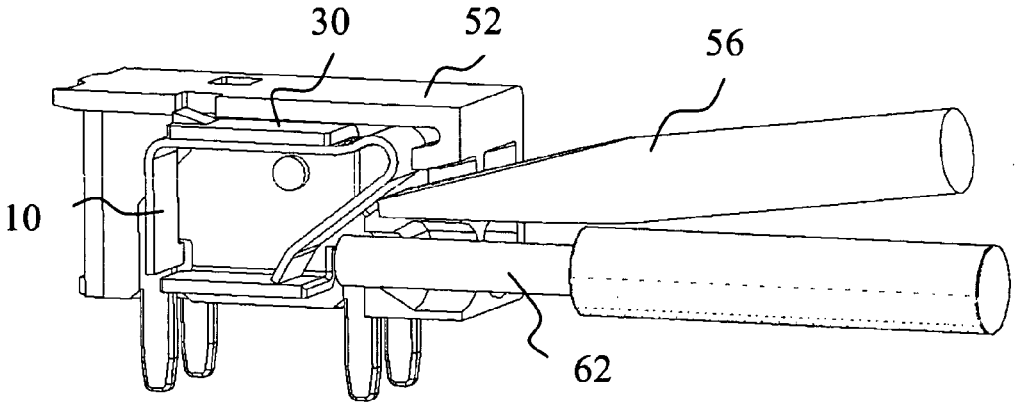
FIG. 10 is another schematic representation of an embodiment of a holder element together with a clamping spring in a housing according to the present invention.

FIG. 9 shows a specific embodiment according to the present invention in which holder element 30 is located in a housing 52. Housing 52 features a receiving opening 54 for a tool 56, as illustrated in FIG. 10, as well as a conductor insertion opening 58. Receiving opening 54 for tool 56 features a wall element 60 which is designed as a stop element for a clamping spring 10 that has been placed in the holder element 30, and for fixing in position tool 56 that has been received in receiving opening 54. As shown in FIG. 10, a tool 56, preferably a screwdriver, is introducible into receiving opening 54 of housing 52 in the direction of holder element 30, in order to open clamping spring 10 located in holder element 30 by deflecting clamping arm 12 of clamping spring 10, to enable a conductor 62, which has been introduced via conductor insertion opening 58, to be clamped in clamping spring 10, or an already clamped conductor 62 to be released. Wall element 60 surrounding the opening of receiving opening 54 may guide the movement of tool 56. In this context, wall element 60 preferably at least partially abuts clamping spring 10 located in holder element 30, preferably in the area of flexural joint 16 and/or clamping arm 12, and thereby serves as a stop element for clamping spring 10 since the freedom of motion of clamping spring 10 in this area is limited by wall element 60 of housing 52. In addition, the formation of wall element 60 allows it, in coordination with holder element 30 and clamping spring 10, to clamp tool 56 to be inserted for opening clamping space 22, so that the operator does not need to hold tool 56 to introduce or connect conductor 62, but rather has both hands free. Thus, the operation of the spring-cage terminal block is greatly facilitated for an operator. Conductor insertion opening 58 preferably has a funnel-shaped design. On the one hand, conductor insertion opening 58 is used as a limit stop for holder element 30 and, on the other hand, as a limitation to a deflection movement of clamping arm 12 of clamping spring 10 located in holder element 30, conductor insertion opening 58 preferably being configured in the area of bent region 34 of clamping arm 12.

To ensure that holder element 30 is securely positionable in the desired position in housing 52, housing 52 features a recess 64 into which a detent lug 47 configured on holder element 30 is fastenable in order to fix holder element 30 in position on housing 52.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS

10 clamping spring
12 clamping arm
14 supporting arm
16 flexural joint
18,20 edge region
22 clamping space
24 limiting arm
26 lug element
28 edge region of the limiting arm
30 holder element
32 opening in the holder element
34 area of clamping arm
36 plate
38, 40 brackets
42 lateral surface
44 recess
46 protuberance
47 detent lug
48 solder pins
50 limiting element
52 housing
54 receiving opening
56 tool
58 conductor insertion opening
60 wall element
62 conductor
64 recess in the housing

What is claimed is:

1. A clamping spring for a spring-cage terminal comprising:

a spring-steel band, the spring-steel band including:

a clamping arm;

a supporting arm;

a flexural joint joining the clamping arm and the supporting arm, the spring-steel band having a greater width in an area of the flexural joint than in an area of the clamping arm and the supporting arm; and a limiting arm integrally formed at an end of the supporting arm opposite the flexural joint, the limiting arm being configured to limit an insertion depth of a conductor into a clamping space of the clamping spring, and the limiting arm including a lug element configured to fix the limiting arm in a desired position.

2. The clamping spring recited in claim 1, wherein the flexural joint has a bend radius in range from 0.3 mm to 0.5 mm.

3. The clamping spring recited in claim 1, wherein the limiting arm is securable by a limiting element so as to prevent movement of the limiting arm.

4. The clamping spring recited in claim 1, wherein the clamping arm includes a bent region at an end opposite the flexural joint.

5. A holder element receiving a clamping spring to provide a spring-cage terminal, the clamping spring including a spring-steel band having a clamping arm, a supporting arm, a flexural joint joining the clamping arm and the supporting arm, and a limiting arm with a lug element integrally formed on the limiting arm, the spring-steel band having a greater width in an area of the flexural joint than in an area of the clamping arm and the supporting arm, the holder element comprising a substantial U-shape and including an electrically conductive material, and having an opening configured to receive the limiting arm so as to fix the limiting arm in position in the holder element using the lug element integrally formed on the limiting arm.

6. The holder element recited in claim 5, wherein at least one lateral surface of the holder element includes a recess configured to limit an insertion depth of a tool.

7. The holder element recited in claim 5, further comprising a protuberance configured to act as a stop element for the clamping arm of the clamping spring.

8. The holder element recited in claim 5, further comprising a detent lug configured to fix the holder element in position in a housing.

9. A housing comprising:

a substantially U-shaped holder clement including an electrically conductive material, the holder element being configured to receive a clamping spring, the clamping spring including a spring-steel band having a clamping arm, a supporting arm, a flexural joint joining the clamping arm and the supporting arm, and a limiting arm with a lug element integrally formed on the limiting arm, the spring-steel band having a greater width in an area of the flexural joint than in an area of the clamping arm and the supporting arm, the holder element having an opening configured to receive the limiting arm so as to fix the limiting arm in position in the holder element using the lug element integrally formed on the limiting arm;

a receiving opening configured to receive a tool, the receiving opening including a wall element having a stop element for the clamping spring, the stop element configured to fix a received tool in position in the receiving opening; and a conductor insertion opening.

10. The housing recited in claim 9, wherein the conductor insertion opening includes a limitation configured to limit a deflection movement of the clamping arm of the clamping spring disposed in the holder element.

11. The housing recited in claim 9, further comprising a recess configured to fasten a detent lug of the holder element so as to fix the holder element in position in the housing.

12. The housing recited in claim 9, wherein the housing is configured to provide a circuit board connection.

* * * * *